US008960334B1

(12) United States Patent
Branton

(10) Patent No.: US 8,960,334 B1
(45) Date of Patent: Feb. 24, 2015

(54) DIFFERENTIAL PRESSURE RELEASE SUB

(76) Inventor: Christopher A. Branton, Bossier City, LA (US)

( * ) Notice: Subject to any disclaimer, the term of this patent is extended or adjusted under 35 U.S.C. 154(b) by 189 days.

(21) Appl. No.: 13/199,990

(22) Filed: Sep. 14, 2011

(51) Int. Cl.
*E21B 21/10* (2006.01)

(52) U.S. Cl.
CPC ..... *E21B 21/103* (2013.01)
USPC ..... 175/317; 166/320; 166/374; 166/386; 166/332.1; 166/334.4

(58) Field of Classification Search
CPC ..... E21B 21/103; E21B 34/07
USPC ..... 166/334.4, 383, 374, 386, 320, 332.1; 137/70; 175/317
See application file for complete search history.

(56) References Cited

U.S. PATENT DOCUMENTS

| | | | | |
|---|---|---|---|---|
| 3,970,147 | A * | 7/1976 | Jessup et al. | 166/374 |
| 4,064,953 | A | 12/1977 | Collins | |
| 5,086,843 | A | 2/1992 | Mims et al. | |
| 5,086,844 | A | 2/1992 | Mims et al. | |
| 5,127,482 | A | 7/1992 | Rector, Jr. | |
| 5,170,847 | A | 12/1992 | Mims et al. | |
| 5,193,619 | A | 3/1993 | Edwards et al. | |
| 5,314,015 | A * | 5/1994 | Streich et al. | 166/184 |
| 6,095,249 | A * | 8/2000 | McGarian et al. | 166/319 |
| 6,450,541 | B1 | 9/2002 | Bakke | |
| 7,431,094 | B2 | 10/2008 | DeClute-Melancon | |
| 7,814,981 | B2 * | 10/2010 | Marcu | 166/308.1 |
| 8,151,891 | B1 * | 4/2012 | Darnell et al. | 166/374 |
| 2009/0095463 | A1 * | 4/2009 | Swan et al. | 166/53 |
| 2010/0126734 | A1 | 5/2010 | Eriksen | |

* cited by examiner

*Primary Examiner* — Jennifer H Gay
*Assistant Examiner* — George Gray
(74) *Attorney, Agent, or Firm* — R. Keith Harrison

(57) ABSTRACT

A differential pressure release sub includes a sub housing having a housing bore, a piston chamber communicating with the housing bore and at least one fluid port communicating with the piston chamber. A piston having a piston bore is disposed for axial displacement in the piston chamber from a first position wherein the at least one fluid port is fluidly sealed from the piston bore to a second position wherein the at least one fluid port is disposed in fluid communication with the piston bore. A first surface having a first surface area is on the piston. A second surface having a second surface area less than the first surface area of the first surface is on the piston.

20 Claims, 5 Drawing Sheets

DIFFERENTIAL PRESSURE RELEASE SUB

FIELD

The disclosure generally relates to drilling of subterranean wells. More particularly, the disclosure relates to a differential pressure release sub which can be opened via differential pressure to resume circulation of drilling fluid from a drill string or coiled tubing to a well bore in the event that the drill string or coiled tubing is inadvertently obstructed.

BACKGROUND

Subterranean oil and gas wells are formed by drilling a well bore through one or more subterranean formations which contain hydrocarbons that are to be extracted from the well. The well bore is typically drilled into the ground by operation of a drilling rig which is placed at the ground surface. A drill string fitted with a drill bit is assembled at the drilling rig and the drill bit is rotated and cuts the well bore into a soil, rock or other material or medium beneath the ground and through the hydrocarbon formation or formations. After drilling, a well casing may be installed in the well bore and the well casing is typically perforated at the location of each formation. A production string is inserted in the well bore to facilitate flow of the hydrocarbons under pressure from the hydrocarbon formation or formations, through the perforations and the production string to the surface of the well.

During the drilling operation, drilling fluid is typically pumped from the well surface through the drill string and is ejected from the drill bit at the cutting end of the string. The ejected drilling fluid then returns to the well surface through the annulus between the drill string and the well bore and is again pumped through the drill string, forming a continuous circulation loop. At the cutting end of the drill string, the pressurized and ejected drilling fluid strikes the medium, enhancing the cutting action of the drill bit and cooling and lubricating the bit. The lubricating effect of the drilling fluid also facilitates disengagement and removal or extraction of the drill bit from the medium and removal of the drill string from the well bore upon conclusion of the drilling operation.

One of the challenges which is sometimes encountered in the drilling of a subterranean hydrocarbon well, particularly under circumstances in which the well is formed in a hard rocky medium, is that large particles or pieces of the medium backflow and form an obstruction in the drill string. The obstruction prevents circulation of the drilling fluid from the well surface through the drill string, drill bit and annulus and back to the well surface. Consequently, the lubricating action of the drilling fluid at the drill bit is lost or compromised and the drill bit becomes stuck in the medium. Recovery of the drill bit and drill string from the well bore may require expensive, laborious and time-consuming retrieval operations which may additionally result in lost income due to delays in production.

Accordingly, a differential pressure release sub which can be opened via differential pressure to resume circulation of drilling fluid between a drill string or coiled tubing and a well bore in the event that the drill string or coiled tubing is inadvertently obstructed is needed.

SUMMARY

The disclosure is generally directed to a differential pressure release sub which can be opened via differential pressure to resume circulation of drilling fluid between a drill string or coiled tubing and a well bore in the event that the drill string or coiled tubing is inadvertently obstructed. The differential pressure release sub may include a sub housing having a housing bore, a piston chamber communicating with the housing bore and at least one fluid port communicating with the piston chamber; a piston having a piston bore disposed for axial displacement in the piston chamber from a first position wherein the at least one fluid port is fluidly sealed from the piston bore to a second position wherein the at least one fluid port is disposed in fluid communication with the piston bore; a first surface having a first surface area on the piston; and a second surface having a second surface area less than the first surface area of the first surface on the piston.

In some embodiments, the differential pressure release sub may include a sub housing having a housing bore, a piston chamber communicating with the housing bore and at least one fluid port communicating with the piston chamber; a piston having a piston bore disposed for axial displacement in the piston chamber from a first position wherein the at least one fluid port is fluidly sealed from the piston bore to a second position wherein the at least one fluid port is disposed in fluid communication with the piston bore; a first O-ring having a first surface area carried by the piston and sealingly engaging the sub housing; and a second O-ring having a second surface area less than the first surface area carried by the piston and sealingly engaging the sub housing.

In some embodiments, the differential pressure release sub may include a sub housing having a first housing bore, a piston chamber disposed in fluid communication with the first housing bore, a second housing bore disposed in fluid communication with the piston chamber, a piston chamber shoulder in the piston chamber at the first housing bore, at least one fluid port communicating with the piston chamber and at least one shear pin opening communicating with the piston chamber; a piston disposed for axial displacement in the piston chamber and having a piston head, a piston body extending from the piston head and a piston bore disposed in fluid communication with the first housing bore and the second housing bore; a first O-ring having a first surface area carried by the piston head of the piston and sealingly engaging the sub housing; a second O-ring having a second surface area less than the first surface area of the first O-ring carried by the piston body of the piston and sealingly engaging the sub housing; at least one shear pin extending through the at least one shear pin opening and engaging the piston head of the piston, the piston displaceable from a first position wherein the piston head engages the piston chamber shoulder and the at least one fluid port is fluidly sealed from the piston bore of the piston to a second position wherein the piston head disengages the piston chamber shoulder; and a fluid flow space formed between the piston chamber shoulder and the piston head of the piston and establishing fluid communication between the piston bore of the piston and the at least one fluid port when the piston is displaced to the second position.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or practice the disclosure and are not intended to limit the scope of the claims. Furthermore, there is no intention to be bound by any expressed or implied theory presented in the preceding technical field, background, brief summary or the following detailed description. While the detailed description which follows is directed to use of a differential pressure release sub in well drilling applications, it will be recognized and understood that the differential pressure release sub may be amenable to a variety of alternative applications.

Figure 6:
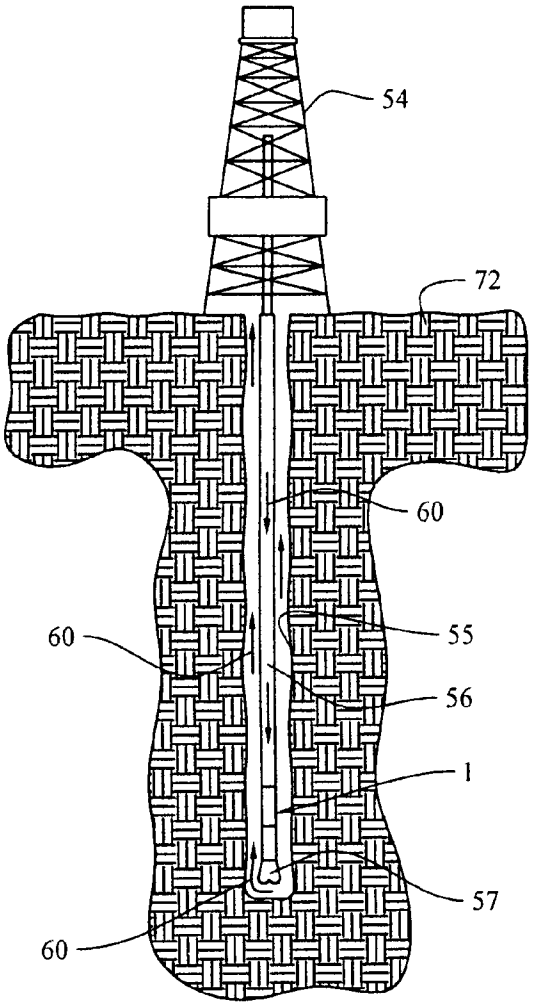
FIG. 6 is a schematic diagram illustrating drilling of a subterranean well bore in exemplary application of the differential pressure release sub.

Referring initially to FIG. 6 of the drawings, an illustrative embodiment of the differential pressure release sub is generally indicated by reference numeral 1. As will be hereinafter described in detail, in exemplary application the differential pressure release sub 1 may be included in coiled tubing or drill string (hereinafter drill string) 56 which drivingly engages a drill bit 57 by rotary table (drill pipe rotation) or mud motor, for example and without limitation. The drill bit 57 may be rotated by operation of a drilling rig 54 to form a subterranean well bore 55 in a soil, rock or other material or medium 72. As the rotating drill bit 57 cuts the medium 72 to form the well bore 55, drilling fluid 60 is circulated from the surface of the well bore 55 through the drill string 56, the differential pressure release sub 1 and the drill bit 57. The drilling fluid 60 is discharged from the drill bit 57 at the drilling interface to cool, lubricate and enhance the cutting action of the drill bit 57 as well as to loosen and dislodge particles and pieces of the medium 72 as the medium 72 is drilled. The drilling fluid 60 returns to the surface of the well bore 55 through the annulus between the drill string 56 and the well bore 55 and re-circulated through the drill string 56. In the event that the drill string 56 becomes inadvertently obstructed with loose particles or pieces of the drilled and dislodged medium 72 during the drilling operation, the differential pressure release sub 1 releases or opens responsive to development of differential fluid pressures between the interior of the drill string 56 and the well bore 55. Accordingly, the opened differential pressure release sub 1 re-establishes circulation of the drilling fluid 60 from the drill string 56 to the well bore 55, facilitating removal or extraction of the drill string 56 and the drill bit 57 from the well bore 55 without the need for expensive retrieval or recovery operations for the drill bit 57 and drill string 56.

Figure 1:
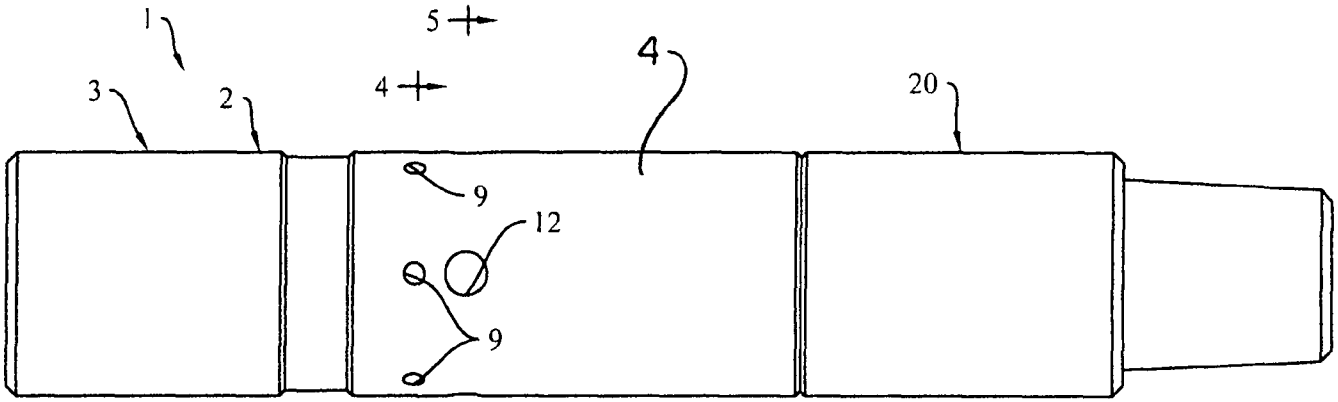
FIG. 1 is a side view of an illustrative embodiment of the differential pressure release sub.
Figure 2:
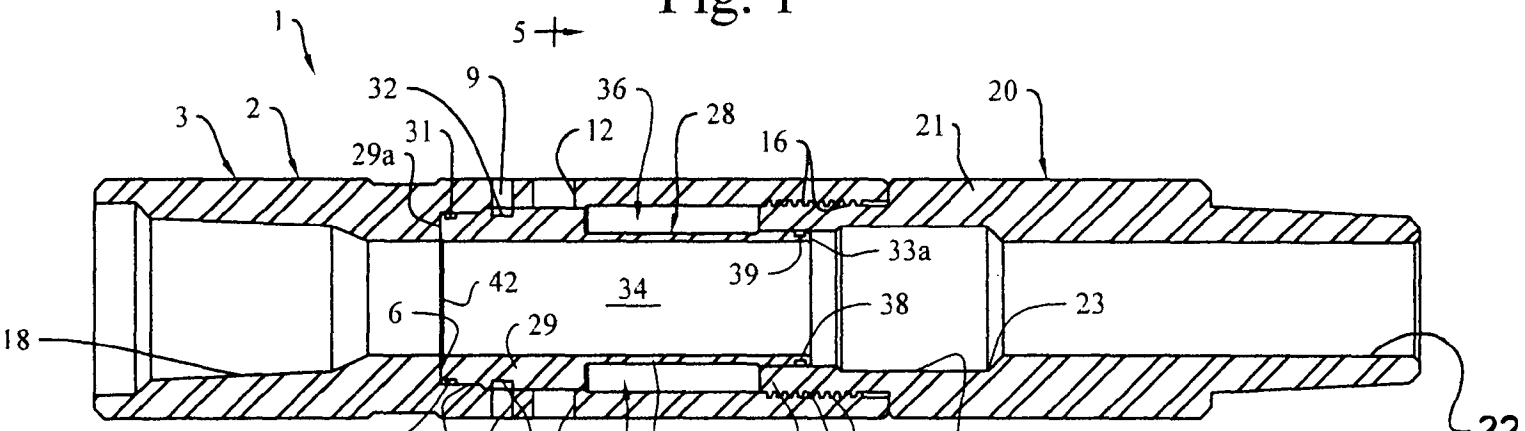
FIG. 2 is a longitudinal sectional view of an illustrative embodiment of the differential pressure release sub deployed in a pre-released or closed position.
Figure 3:
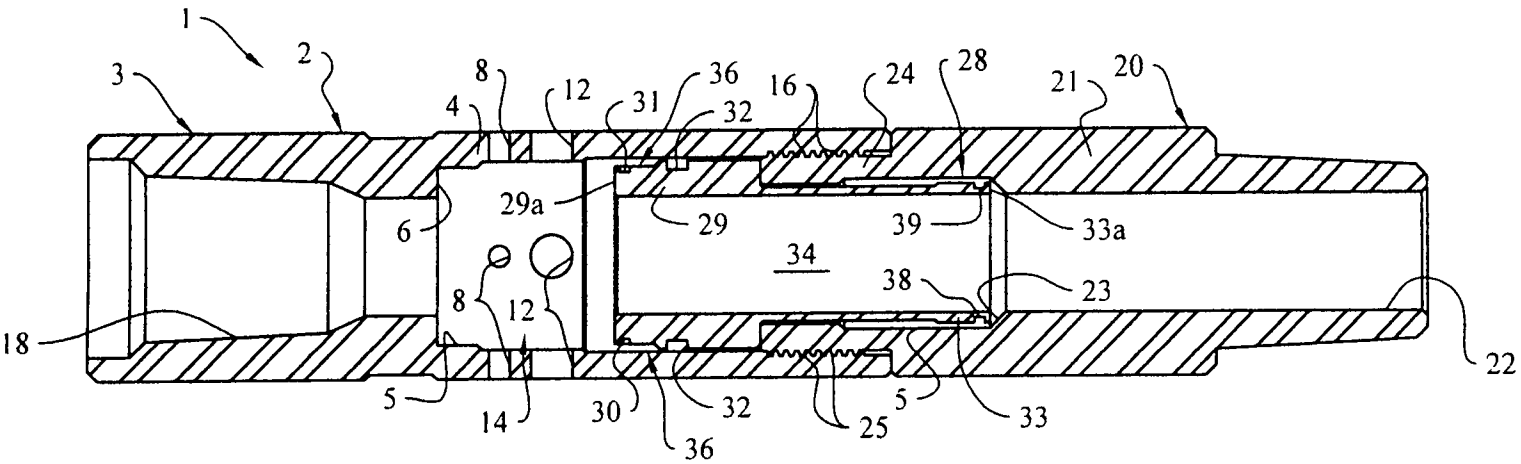
FIG. 3 is a longitudinal sectional view of an illustrative embodiment of the differential pressure release sub deployed in a released or open position.

Referring next to FIGS. 1-5 and 10 of the drawings, the differential pressure release sub 1 includes a sub housing 2 which may be generally elongated and cylindrical. The sub housing 2 is adapted to be coupled to the drill string 56 (FIG. 6) using a threaded attachment and/or any other suitable attachment technique which is known by those skilled in the art. As illustrated in FIGS. 2 and 3, in some embodiments, the sub housing 2 may include a first housing portion 3 and a second housing portion 20 which is coupled to the first housing portion 3. The first housing portion 3 and the second housing portion 20 may be fabricated using conventional casting and machining techniques known by those skilled in the art. In other embodiments, the sub housing 2 may be fabricated in one piece using conventional casting and machining techniques known by those skilled in the art. As further illustrated in FIGS. 2 and 3, the first housing portion 3 may include a first housing wall 4. The first housing wall 4 may define a first housing bore 18. The first housing wall 4 may further define at least a portion of a piston chamber 5 which communicates with and is disposed in axially-aligned relationship with respect to the first housing bore 18. A piston shoulder 6 may be at the interface between the piston chamber 5 and the first housing bore 18.

As further illustrated in FIGS. 2 and 3, at least one shear pin opening 8 may extend through the first housing wall 4 and communicate with the piston chamber 5. As illustrated in the cross-sectional view of FIG. 4, in some embodiments, any desired number of multiple shear pin openings 8 may extend through the first housing wall 4 in spaced-apart relationship with respect to each other about the circumference of the sub housing 2. Each shear pin opening 8 is sized and configured to receive a correspondingly-sized and shaped shear pin 9 (FIG. 2) for purposes which will be hereinafter described. At least one fluid port 12 extends through the first housing wall 4 and communicates with the fluid flow chamber 5. As illustrated in the cross-sectional view of FIG. 5, in some embodiments, any desired number of multiple fluid ports 12 may extend through the first housing wall 4 in spaced-apart relationship with respect to each other about the circumference of the sub housing 2.

The second housing portion 20 of the sub housing 2 may include a second housing wall 21. The second housing wall 21 may define a second housing bore 22 which communicates with and is disposed in axially-aligned relationship with respect to the piston chamber 5. The second housing wall 21 may further define at least a portion of the piston chamber 5, as illustrated in FIGS. 2 and 3. A bore shoulder 23 may be at the interface between the piston chamber 5 and the second housing bore 22. A housing attachment nipple 24 may extend from the second housing wall 21. Accordingly, the first housing portion 3 may be coupled to the second housing portion 20 of the sub housing 2 by mating interior housing threads 16 on the first housing wall 4 with companion exterior housing threads 25 on the housing attachment nipple 24.

A pressure-actuated piston 28 is disposed for axial displacement in the piston chamber 5 between a pre-released or closed position (FIG. 2) and a released or open position (FIG. 3). The piston 28 may include a piston head 29 and a piston body 33 which extends from the piston head 29. A piston bore 34 extends through the piston head 29 and the piston body 33. The piston bore 34 of the piston 28 communicates with and is disposed in axial alignment with the first housing bore 18 of the first housing portion 3 and with the second housing bore 22 of the second housing portion 20. Accordingly, in operation of the differential pressure release sub 1, which will be hereinafter described, the first housing bore 18, the piston bore 34 and the second housing bore 22 form an unimpeded conduit for flow of the drilling fluid 60 (FIG. 6) through the drill string 56 under normal drilling conditions.

The piston head 29 may have a diameter which is larger than that of the piston body 33 of the piston 28. The piston head 29 has a piston head end 29*a* and the piston body 33 has a piston body end 33*a*. When the piston 28 is disposed in the closed position of FIG. 2, the piston head end 29*a* of the piston head 29 may engage the piston chamber shoulder 6 of the piston chamber 5, forming a mating line 42 at the point of engagement between the piston head 29 and the first housing wall 4 of the first housing portion 3. The piston body end 33*a* of the piston body 33 is spaced-apart with respect to the bore shoulder 23. When the piston 28 is disposed in the open position of FIG. 3, the piston head end 29*a* of the piston 28 is spaced-apart from the piston chamber shoulder 6 and the piston body end 33*a* of the piston body 33 may engage the bore shoulder 23 of the piston chamber 5. A fluid flow space 14 may be defined between the piston chamber shoulder 6 and the piston head end 29*a* of the piston head 29. The piston bore 34 of the piston 28 is disposed in fluid communication with the fluid ports 12 in the first housing wall 4 of the first housing portion 3 through the fluid flow space 14.

Figure 10:
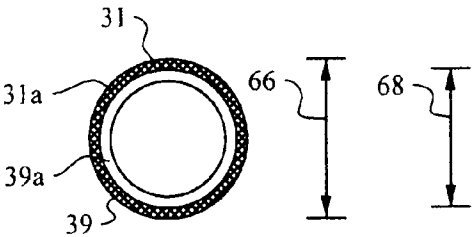
FIG. 10 is a schematic diagram which illustrates differences in surface areas between the O-rings of the differential pressure release sub in facilitating deployment of the differential pressure release sub from the closed position to the open position.

A piston head O-ring groove 30 may be provided in the piston head 29 generally at or adjacent to the piston head end 29*a*. A piston head O-ring 31 may be seated in the piston head O-ring groove 30. The piston head O-ring 31 may impart a fluid-tight seal between the piston head 29 and the interior surface of the piston chamber 5. A piston body O-ring groove 38 may be provided in the piston body 33 generally at or adjacent to the piston body end 33*a*. A piston body O-ring 39 may be seated in the piston body O-ring groove 38. The piston body O-ring 39 may impart a fluid-tight seal between the piston body 33 and the interior surface of the piston chamber 5. As illustrated in FIG. 10, the piston head O-ring 31 has a diameter 66 which is greater than the diameter 68 of the piston body O-ring 39. Accordingly, the piston head O-ring 31 has a surface area 31*a* which is larger than a surface area 39*a* of the piston body O-ring 39 by a magnitude that corresponds to the difference in diameters 66, 68 between the piston head O-ring 31 and the piston body O-ring 39, respectively. Shear pin seats 32 (FIG. 2) may be provided in the outer surface of the piston head 29 for purposes which will be hereinafter described.

Figure 5:
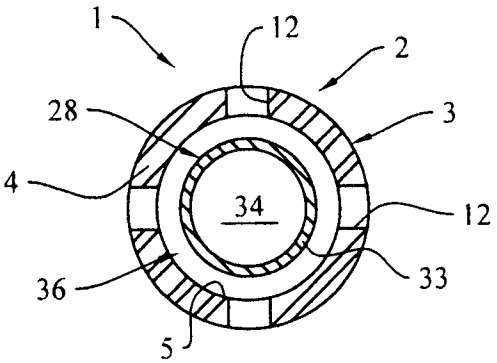
FIG. 5 is a cross-sectional view, taken along section lines 5-5 in FIG. 1.
Figure 4:
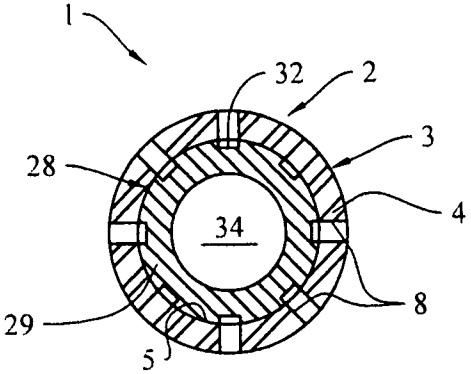
FIG. 4 is a cross-sectional view, taken along section lines 4-4 in FIG. 1.

When the piston 28 is in the closed position illustrated in FIG. 2, the shear pin seats 32 in the piston head 29 register with the respective shear pin openings 8 in the first housing wall 4 of the first housing portion 3. Shear pins 9 may be extended through each shear pin opening 8 in the first housing wall 4 and seated in the registering shear pin seats 32 in the piston head 29. Accordingly, the shear pins 9 normally maintain the piston 28 in the closed position illustrated in FIG. 2. As illustrated in FIGS. 2 and 5, an annular piston slide space 36 may be defined between the outer surface of the piston body 33 and the interior surface of the first housing wall 4. The fluid ports 12 in the first housing wall 4 may communicate with the piston slide space 36. However, the piston head O-ring 31 and the piston body O-ring 38 impart a fluid-tight seal between the piston bore 34 of the piston 28 and the piston slide space 36 and the fluid ports 12, preventing flow of fluid from the piston bore 34 through the fluid ports 12.

In the event that a fluid pressure differential of selected threshold magnitude (hereinafter described) develops between the piston bore 34 of the piston 28 and the exterior of the sub housing 2, as will be hereinafter further described, the shear pins 9 in the respective shear pin openings 8 are sheared and the piston 28 is displaced from the closed position of FIG. 2 to the open position of FIG. 3. As the piston 28 traverses the piston chamber 5, the piston head 29 slides along the piston slide space 36 toward the housing attachment nipple 24 of the second housing portion 20. When the piston 28 reaches the open position illustrated in FIG. 3, the piston head 29 may engage the housing attachment nipple 24 and the piston body end 33*a* of the piston body 33 may engage the bore shoulder 23 at the interface between the piston chamber 5 and the second housing bore 22. The fluid flow space 14 forms between the piston chamber shoulder 6 and the piston head end 29*a* of the piston head 29. Thus, the piston bore 34 of the piston 28 communicates with the fluid ports 12 in the first housing wall 4 through the fluid flow space 14, facilitating flow of drilling fluid 60 from the piston bore 34 through the fluid flow space 14 and the fluid ports 12, respectively, to the well bore 55 (FIG. 6) outside the sub housing 2.

Figure 7:
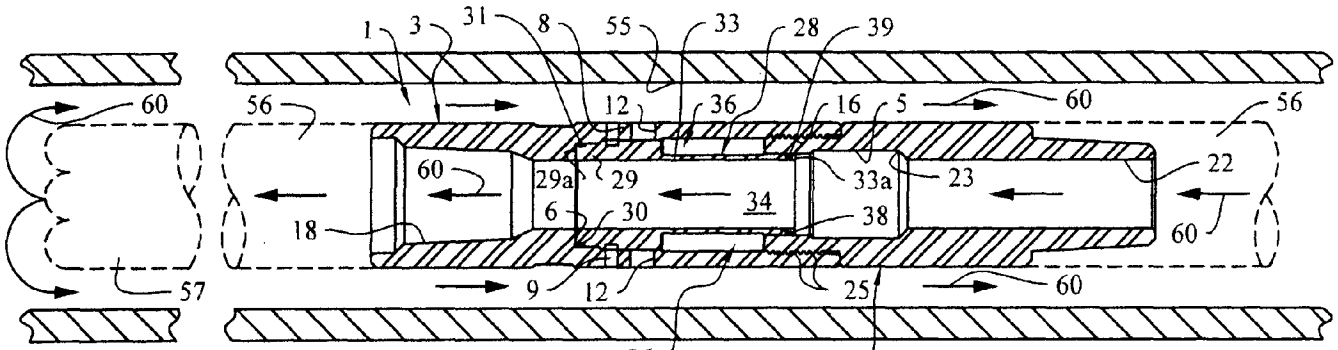
FIG. 7 is a longitudinal sectional view of an illustrative embodiment of the differential pressure release sub, coupled to a drill string (illustrated in phantom) and inserted in a well bore, with the differential pressure release sub deployed in the pre-released or closed position and drilling fluid flowing through the drill string and the sub, discharging from a drill bit (illustrated in phantom) coupled to the drill string and flowing through the annulus of the well bore, respectively, under normal drilling conditions.

Referring next to FIGS. 6-11 of the drawings, in exemplary application, the differential pressure release sub 1 is assembled in the coiled tubing or drill string 56. The drill bit 57 is coupled to the drilling end of the drill string 56. As illustrated in FIG. 6, the differential pressure release sub 1 may be placed in generally close proximity to the drill bit 57 in the drill string 56. As illustrated in FIG. 7, the piston 28 is set in the closed or pre-released position in the piston chamber 5. The shear pins 9 are extended through the sheer pin openings 8 and are seated in the respective shear pin seats 32 in the piston head 29 to secure the piston 28 in the closed position.

As the drilling rig 54 (FIG. 6) is operated to rotate the drill bit 57 through the drill string 56, the drill bit 57 drills the medium 72 to form the subterranean well bore 55. As the rotating drill bit 57 forms the well bore 55, drilling fluid 60 may be continually circulated from the surface of the well bore 55 through the drill string 56, the differential pressure release sub 1, the drill bit 57 and back to the surface of the well bore 55 through the annulus between the drill string 56 and the well bore 55. At the cutting end of the drill string 56, the drilling fluid 60 cools, lubricates and enhances the cutting action of the drill bit 57 as well as dislodges particles and pieces of the medium 72. Although the well bore 55 illustrated in FIG. 6 is shown as being vertical, it will be recognized and understood that the differential pressure release sub 1 is equally applicable to drilling applications in which the well bore 55 is horizontal or at any angle between vertical and horizontal.

Figure 9:
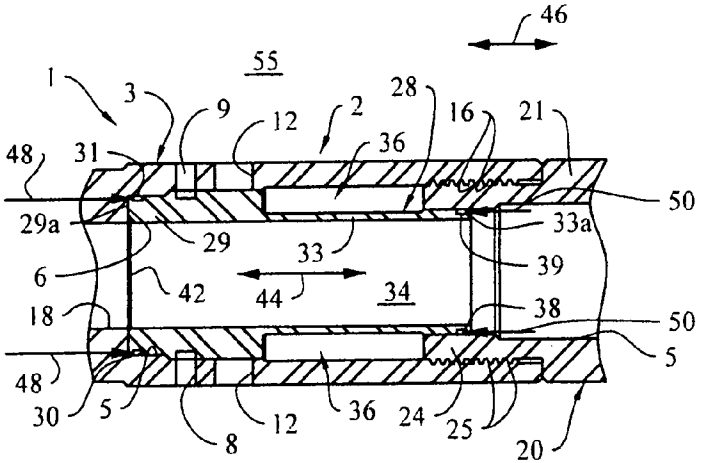
FIG. 9 is a longitudinal sectional view of a portion of the differential pressure release sub deployed in the pre-released position, more particularly illustrating application of differential pressure to O-rings having different surface areas in deployment of the differential pressure release sub from the closed position to the open position.
Figure 11:
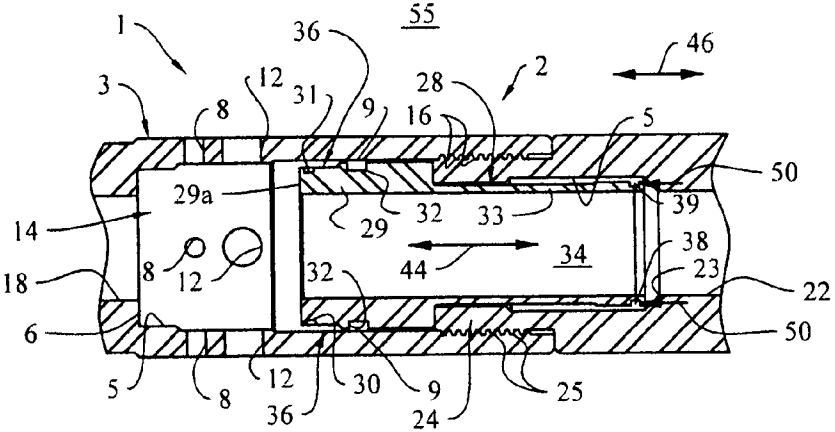
FIG. 11 is a longitudinal sectional view of a portion of the differential pressure release sub deployed in the open position as a result of differential pressures applied to the O-rings having different surface areas.

As illustrated in FIG. 7, under normal drilling conditions, the drilling fluid 60 flows unobstructed and substantially unimpeded through the drill string 56, the differential pressure release sub 1 and the drill bit 57 and returns to the surface of the well bore 55. Accordingly, as illustrated in FIG. 9, the bore pressure 44 of the drilling fluid 60 in the piston bore 34 of the piston 28 substantially equals the well pressure 46 of the drilling fluid 60 in the well bore 55. Due to the larger surface area 31*a* (FIG. 10) of the piston head O-ring 31 relative to the surface area 39*a* of the piston body O-ring 39, the total pressure 48 (bore pressure 44×surface area 31*a* of piston head O-ring 31) which is applied to the piston head O-ring 31 exceeds the opposing total pressure 50 (bore pressure 44×surface area 39*a* of piston body O-ring 39) which is applied to the piston body O-ring 39. Therefore, the total pressure 48 which is applied to the piston head O-ring 31 tends to bias the piston 28 toward the open or released position illustrated in FIG. 11. However, as long as the bore pressure 44 and the well pressure 46 remain substantially the same, the strength of the shear pins 9 is sufficient to maintain the piston 28 in the closed or pre-released position illustrated in FIG. 9 against the biasing pressure which is exerted by the total pressure 48 against the piston 28.

Figure 8:
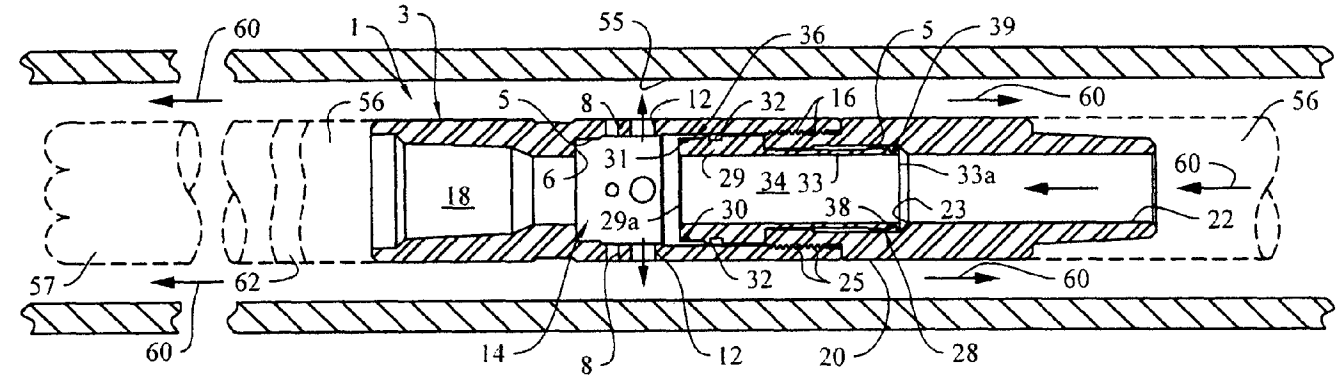
FIG. 8 is a longitudinal sectional view of an illustrative embodiment of the differential pressure release sub, coupled to the drill string (illustrated in phantom) and inserted in the well bore with the differential pressure release sub deployed in the released or open position via differential pressure due to the presence of an obstruction in the drill string and drilling fluid circulating from the drill string through fluid ports in the open sub and into the annulus of the well bore, respectively.

As illustrated in FIG. 8, in the event that an obstruction 62 (illustrated in phantom) forms in the drill string 56 between the differential pressure release sub 1 and the drill bit 57 during the drilling operation due to backflow of loose particles and pieces of the cut and dislodged medium 72, the bore pressure 44 (FIG. 11) of the drilling fluid 60 in the piston bore 34 increases since the drilling fluid 60 is not discharged through the drill bit 57 into the well bore 55 as occurs under normal drilling conditions. Accordingly, the magnitude of the bore pressure 44 in the piston bore 34 exceeds the magnitude of the well pressure 46 in the well bore 55. Therefore, due to the greater surface area 31*a* (FIG. 10) of the piston head O-ring 31 relative to the surface area 39*a* of the piston body O-ring 39, the total pressure 48 (FIG. 9) which is applied against the piston head O-ring 31 increases at a greater rate than the opposing total pressure 50 which is applied against the piston body O-ring 39. As the disparity between the total pressure 48 applied to the piston head O-ring 31 and the opposing total pressure 50 applied to the piston body O-ring 39 continues to increase, the biasing effect of the total pressure 48 eventually overcomes the combined total pressure 50 applied to the piston body O-ring 39 and the retaining strength of the shear pins 9. Consequently, the shear pins 9 are sheared in the respective shear pin openings 8 and the shear pin seats 32 and the piston 28 is thus displaced from the closed position of FIGS. 7 and 9 to the open position of FIGS. 8 and 11, forming the fluid flow space 14 in the piston chamber 5. As illustrated in FIG. 8, the piston bore 34 of the piston 28 is then disposed in fluid communication with the fluid ports 12 through the fluid flow space 14 in the piston chamber 5. The pressurized drilling fluid 60 flows from the piston bore 34 of the piston 28 through the fluid flow space 14 and the fluid ports 12, respectively, into the well bore 55 to the well bore surface. The drilling fluid 60 may be continually circulated back through the drill string 56, the differential pressure release sub 1 and the well bore 55, respectively. As further illustrated in FIG. 8, a portion of the drilling fluid 60 may flow through the well bore 55 to the drill bit 57, lubricating and facilitating disengagement and extraction of the drill bit 57 and removal of the drill string 56 and the drill bit 57 from the well bore 55.

It will be appreciated by those skilled in the art that the differential pressure release sub is effective in re-establishing circulation of drilling fluid through a drill string and a well bore under circumstances in which the presence of an obstruction in the drill string blocks circulation of the drilling fluid. Accordingly, the differential pressure release sub can substantially reduce costs, labor and delays in production which may otherwise result in the event that a retrieval operation need be carried out to extricate the drill bit and drill string from the well bore. Referring again to FIG. 4 of the drawings, the number of shear pins 9 which are inserted in the respective shear pin openings 8 and shear pin seats 32 can be varied to control the magnitude of differential pressure which is required to open the differential pressure release sub 1 according to existing downhole conditions. It will be further appreciated by those skilled in the art that the differential pressure release sub 1 can be deployed in drilling applications having vertical, horizontal or other orientations.

While illustrative embodiments of the disclosure have been described above, it will be recognized and understood that various modifications can be made and the appended claims are intended to cover all such modifications which may fall within the spirit and scope of the disclosure.

What is claimed is:

1. A differential pressure release sub, comprising:

a sub housing having a first housing bore, a piston chamber communicating with said first housing bore, a second housing bore disposed in fluid communication with said piston chamber, a piston chamber shoulder of fixed position in said piston chamber at said first housing bore, at least one fluid port communicating with said piston chamber and a bore shoulder in said piston chamber at said second housing bore;

a piston having a piston head, a piston body extending from said piston head and a piston bore disposed in fluid communication with said first housing bore and said second housing bore, said piston disposed for axial displacement in said piston chamber from a first position wherein said piston head engages said piston chamber shoulder and said at least one fluid port is fluidly sealed from said piston bore to a second position wherein said piston head disengages said piston chamber shoulder and said piston body of said piston engages said bore shoulder and said at least one fluid port is disposed in fluid communication with said piston bore;

at least one piston retaining member engaging said piston, said at least one piston retaining member retaining said piston in said first position with a retaining force corresponding to a retaining strength of said at least one piston retaining member;

said housing bore of said sub housing and said piston bore of said piston forming an unimpeded conduit for flow of fluid in said first position of said piston;

a first surface having a first surface area on said piston;

a second surface having a second surface area less than said first surface area of said first surface on said piston;

said first surface and said second surface disposed in fluid communication with said housing bore of said sub housing;

a piston slide space between said piston and said sub housing, said piston slide space closed from said at least one fluid port in said first position of said piston; and said piston slides in said piston chamber from said first position to said second position when a first total pressure applied to said first surface area of said first surface overcomes a second total pressure applied to said second surface area of said second surface and said retaining strength of said at least one piston retaining member, the first total pressure being applied initially and continually in response to an increase of fluid pressure in said piston bore relative to fluid pressure exterior to said sub housing.

2. The differential pressure release sub of claim 1 wherein said first surface comprises a first O-ring having a first O-ring diameter and said second surface comprises a second O-ring having a second O-ring diameter less than said first O-ring diameter.

3. The differential pressure release sub of claim 1 wherein said first surface is on said piston head and said second surface is on said piston body of said piston.

4. The differential pressure release sub of claim 3 wherein said piston slide space is between said piston body of said piston and said sub housing.

5. The differential pressure release sub of claim 3 further comprising a fluid flow space formed between said piston head of said piston and said sub housing when said piston is displaced to said second position.

6. The differential pressure release sub of claim 1 wherein said piston retaining member comprises at least one shear pin opening in said sub housing and at least one shear pin in said at least one shear pin opening and engaging said piston.

7. The differential pressure release sub of claim 1 wherein said sub housing comprises a first housing portion and a second housing portion carried by said first housing portion.

8. The differential pressure release sub of claim 1 wherein said at least one fluid port comprises a plurality of fluid ports.

9. A differential pressure release sub, comprising:

a sub housing having a first housing bore, a piston chamber communicating with said first housing bore, a second housing bore disposed in fluid communication with said piston chamber, a piston chamber shoulder of fixed position in said piston chamber at said first housing bore, at least one fluid port communicating with said piston chamber and a bore shoulder in said piston chamber at said second housing bore;

a single one-piece piston having a piston head, a piston body extending from said piston head and a piston bore disposed in fluid communication with said first housing bore and said second housing bore, said piston disposed for axial displacement in said piston chamber from a first position wherein said piston head engages said piston chamber shoulder and said at least one fluid port is fluidly sealed from said piston bore to a second position wherein said piston head disengages said piston chamber shoulder and said piston body of said piston engages said bore shoulder and said at least one fluid port is disposed in fluid communication with said piston bore;

at least one shear pin engaging said piston head of said piston and retaining said piston in said first position with a retaining force corresponding to a retaining strength of said at least one shear pin;

said housing bore of said sub housing and said piston bore of said piston forming an unimpeded conduit for flow of fluid in said first position of said piston;

a first O-ring having a first surface area carried by said piston and sealingly engaging said sub housing;

a second O-ring having a second surface area less than said first surface area carried by said piston and sealingly engaging said sub housing;

said first surface and said second surface disposed in fluid communication with said housing bore of said sub housing;

a piston slide space between said piston and said sub housing, said piston slide space closed from said at least one fluid port in said first position of said piston; and said piston slides in said piston chamber from said first position to said second position when a first total pressure applied to said first surface area of said first O-ring overcomes a second total pressure applied to said second surface area of said second O-ring and said retaining strength of said at least one shear pin, the first total pressure being applied initially and continually in response to an increase of fluid pressure in said piston bore relative to fluid pressure exterior to said sub housing.

10. The differential pressure release sub of claim 9 wherein said first O-ring is carried by said piston head and said second O-ring is carried by said piston body.

11. The differential pressure release sub of claim 10 wherein said piston slide space is between said piston body of said piston and said sub housing.

12. The differential pressure release sub of claim 10 further comprising a fluid flow space between said piston head of said piston and said sub housing when said piston is in said second position.

13. The differential pressure release sub of claim 9 further comprising at least one shear pin opening in said sub housing and wherein said shear pin is in said at least one shear pin opening and engages said piston.

14. The differential pressure release sub of claim 9 wherein said sub housing comprises a first housing portion and a second housing portion carried by said first housing portion.

15. The differential pressure release sub of claim 9 wherein said at least one fluid port comprises a plurality of fluid ports.

16. A differential pressure release sub, comprising:

a sub housing having a first housing bore, a piston chamber disposed in fluid communication with said first housing bore, a second housing bore disposed in fluid communication with said piston chamber, a piston chamber shoulder of fixed position in said piston chamber at said first housing bore, at least one fluid port communicating with said piston chamber and at least one shear pin opening communicating with said piston chamber and a bore shoulder in said piston chamber at said second housing bore;

a single one-piece piston disposed for axial displacement in said piston chamber and having a piston head, a piston body extending from said piston head and a piston bore disposed in fluid communication with said first housing bore and said second housing bore;

a first O-ring having a first surface area carried by said piston head of said piston and sealingly engaging said sub housing;

a second O-ring having a second surface area less than said first surface area of said first O-ring carried by said piston body of said piston and sealingly engaging said sub housing;

at least one shear pin extending through said at least one shear pin opening and engaging said piston head of said piston, said at least one shear pin retaining said piston in said first position with a retaining force corresponding to a retaining strength of said at least one shear pin;

said piston is displaceable from a first position wherein said piston head engages said piston chamber shoulder and said at least one fluid port is fluidly sealed from said piston bore of said piston to a second position wherein said piston head disengages said piston chamber shoulder and said piston body of said piston engages said bore shoulder;

said housing bore of said sub housing and said piston bore of said piston forming an unimpeded conduit for flow of fluid in said first position of said piston;

said first surface area of said first O-ring and said second surface area of said second O-ring disposed in fluid communication with said first housing bore and said second housing bore of said sub housing;

a fluid flow space formed between said piston chamber shoulder and said piston head of said piston and establishing fluid communication between said piston bore of said piston and said at least one fluid port when said piston is displaced to said second position;

a piston slide space between said piston and said sub housing, said piston slide space closed from said at least one fluid port in said first position of said piston; and said piston slides in said piston chamber from said first position to said second position when a first total pressure applied to said first surface area of said first O-ring overcomes a second total pressure applied to said second surface area of said second O-ring and said retaining strength of said at least one shear pin, the first total pressure being applied initially and continually in response to an increase of fluid pressure in said piston bore relative to fluid pressure exterior to said sub housing.

17. The differential pressure release sub of claim 16 wherein said sub housing comprises a first housing portion and a second housing portion engaging said first housing portion and said first housing bore extends through said first housing portion and said second housing bore extends through said second housing portion.

18. The differential pressure release sub of claim 16 wherein said piston slide space is between said piston body of said piston and said sub housing.

19. The differential pressure release sub of claim 16 further comprising a bore shoulder in said piston chamber at said second housing bore and wherein said piston body of said piston engages said bore shoulder when said piston is displaced to said second position.

20. The differential pressure release sub of claim 16 wherein said at least one fluid port comprises a plurality of fluid ports.

* * * * *